US006250773B1

(12) United States Patent
Lai

(10) Patent No.: US 6,250,773 B1
(45) Date of Patent: Jun. 26, 2001

(54) NIGHT LAMP

(76) Inventor: Li-Chun Lai, 2F-1, No.33, Sec. 1, Min Sheng Rd., Panchiao City, Taipei Hsien (TW)

( * ) Notice: Subject to any disclaimer, the term of this patent is extended or adjusted under 35 U.S.C. 154(b) by 0 days.

(21) Appl. No.: 09/598,899

(22) Filed: Jun. 22, 2000

(51) Int. Cl.[7] ..... H01R 33/00
(52) U.S. Cl. ..... 362/226; 362/84; 362/253
(58) Field of Search ..... 362/84, 226, 253, 362/95, 806; 439/490, 694, 695, 86

(56) References Cited

U.S. PATENT DOCUMENTS 5,622,424 * 4/1997 Brady ..... 362/226
5,662,408 * 9/1997 Marischen ..... 362/84

* cited by examiner

*Primary Examiner*—Y. Quach

(74) *Attorney, Agent, or Firm*—Bacon & Thomas, PLLC

(57) ABSTRACT

A novel night lamp comprises essentially by positioning a luminescent sheet against snap protrusions provided in a semi-circular arc-like upper shade such that the luminescent sheet can be affected by said arc curvature of said upper shade to form a corresponding semi-circular arc plane and protrude out of an open portion on said upper shade. As said upper shade covers said night lamp body, the luminescent sheet is hold between the upper shade and the semi-circular arc-like protruding block of the night lamp body and fits intimately against the protruding body. At the same time, the conductive ends extended on ends of said luminescent sheet will contact conductive springs slipped on shaft levers provided on a positioning seat of said night lamp body. As a result, an electric power can be conducted via said conductive copper pieces and said conductive springs to said luminescent sheet and activate said luminescent sheet to luminescence. Many effects such as safety, power-saving, long service life and environment protecting as well as an object of giving the entire night lamp a novel and unique semi-cylindrical configuration can be achieved.

6 Claims, 4 Drawing Sheets

NIGHT LAMP

BACKGROUND OF THE INVENTION

1. Field of the Invention

The invention relates to a novel night lamp structure, and in particular, to a night lamp configured integrally in a semi-cylindrical structure such that it has a novel and unique style and gives users an unusual visual effect.

2. Description of the Prior Art

As us known, a night lamp is used at a dark site in the house such as, the bedroom, passageways, or staircases to lighten and prevent the user from accidents when he passes these places. However, since a conventional night lamp employs generally a tungsten filament as the light source that consumes great electric power and has short life-time, as well as can generate high heat during emitting light, the user might be in a risk of being hurt once he touches the lamp carelessly. Further, when something covers the conventional lamp bulb, it may be affected by the high heat generated therefrom and undergoes insidious burning that may result into a fire. Therefore, lightening with a tungsten filament lamp is a way that is not safe enough but also is uneconomical due to the above-mentioned consumption of great electricity that increases correspondingly the cost required.

Accordingly, the prior art has many disadvantages that need further improvement. In view of solving these disadvantages associated with the prior art night lamp and attempting to improve it, the inventor has devoted in an intensive study for many years and found finally the novel night lamp of the present invention.

SUMMARY OF THE INVENTION

One object of the invention is to provide a night lamp having a semi-cylinder structure, wherein the internal luminescent sheet has a corresponding curve shape that gives the lamp an unique and novel integral configuration and increases the added-value thereof.

Another object of the invention is to provide a night lamp using a luminescent sheet as its light source that makes it being a safe, power-saving, long service life and environment protecting night lamp.

The novel night lamp having above-mentioned advantages according to the invention comprises a night lamp body, an upper shade, a luminescent sheet, a light-diffusing sheet and a positioning set; wherein, said upper shade has a semi-circular arc shape and has an open portion. Said open portion has a snap protrusion provided on its inner surface. Whereby said luminescent sheet can be positioned and protrude in said open portion of said upper shade. Accordingly, said luminescent sheet can be affected by said circular arc of said upper shade and form a corresponding semi-circular arc plane. Said light-diffusing sheet is used to cover said luminescent sheet and acts as an insulator against a power supply. A protruding block in a form of semi-circular arc is provided on said night lamp body. Snap engaging recesses are provided along both lateral sides of said protruding block for snap engaging with said snap protrusions on the upper shade. Further, a positioning seat is provided on one end of said protruding block. Two shaft levers are provided vertically about the central portion of said positioning seat. Two conductive copper pieces are slipped on said two shaft levers respectively and penetrate through slots on said positioning seat to protrude at the back of said night lamp body for forming a socket and meanwhile, fixing said positioning set on said positioning seat in a manner that said two shaft levers on said positioning seat can penetrate into hollow cylinders extending upwardly on the top surface of said positioning set. Top ends of said hollow cylinders are shaped into inclined openings such that, as the two conductive springs are slipped on said two shaft levers, they can protrude out of said hollow cylinder. With this configuration, as said semi-circular arc-like upper shade covers said night lamp body, the entire night lamp will be present as a semi-cylindrical body, and said conductive springs protruding out of said hollow cylinder will contact said conductive ends on said luminescent sheet. As a result, an electric power can be conducted via said conductive copper pieces and said conductive springs to said luminescent sheet and activates said luminescent sheet to luminescence.

BRIEF DESCRIPTION OF THE DRAWINGS

The drawings disclose an illustrative embodiment of the present invention that serves to exemplify the various advantages and objects hereof, and are as follows.

REPRESENTATIVE SYMBOLS OF MAIN ELEMENTS

| | | | |
|---|---|---|---|
| 10 | night lamp | 1 | night lamp body |
| 11 | protruding block | 111 | snap engaging recess |
| 12 | positioning seat | 121b | shaft lever |
| 121a | shaft lever | 122b | slot |
| 122a | slot | 123b | positioning opening |
| 123a | positioning opening | 2b | conductive copper piece |
| 2a | conductive copper piece | 21b | hole |
| 21a | hole | 22b | hole |
| 22a | hole | 3 | positioning set |
| 31b | hollow cylinder | 31a | hollow cylinder |
| 32b | engaging opening | 32a | engaging opening |
| 4b | conductive spring | 4a | conductive spring |
| 5 | upper shade | 51 | open portion |
| 52 | snap protrusion | 6 | luminescent sheet |
| 61 | conductive end | 62 | conductive end |
| 7 | light-diffusing sheet | 8 | screw |
| 9 | socket board | | |

DETAILED DESCRIPTION OF THE PREFERRED EMBODIMENT

Figure 1:
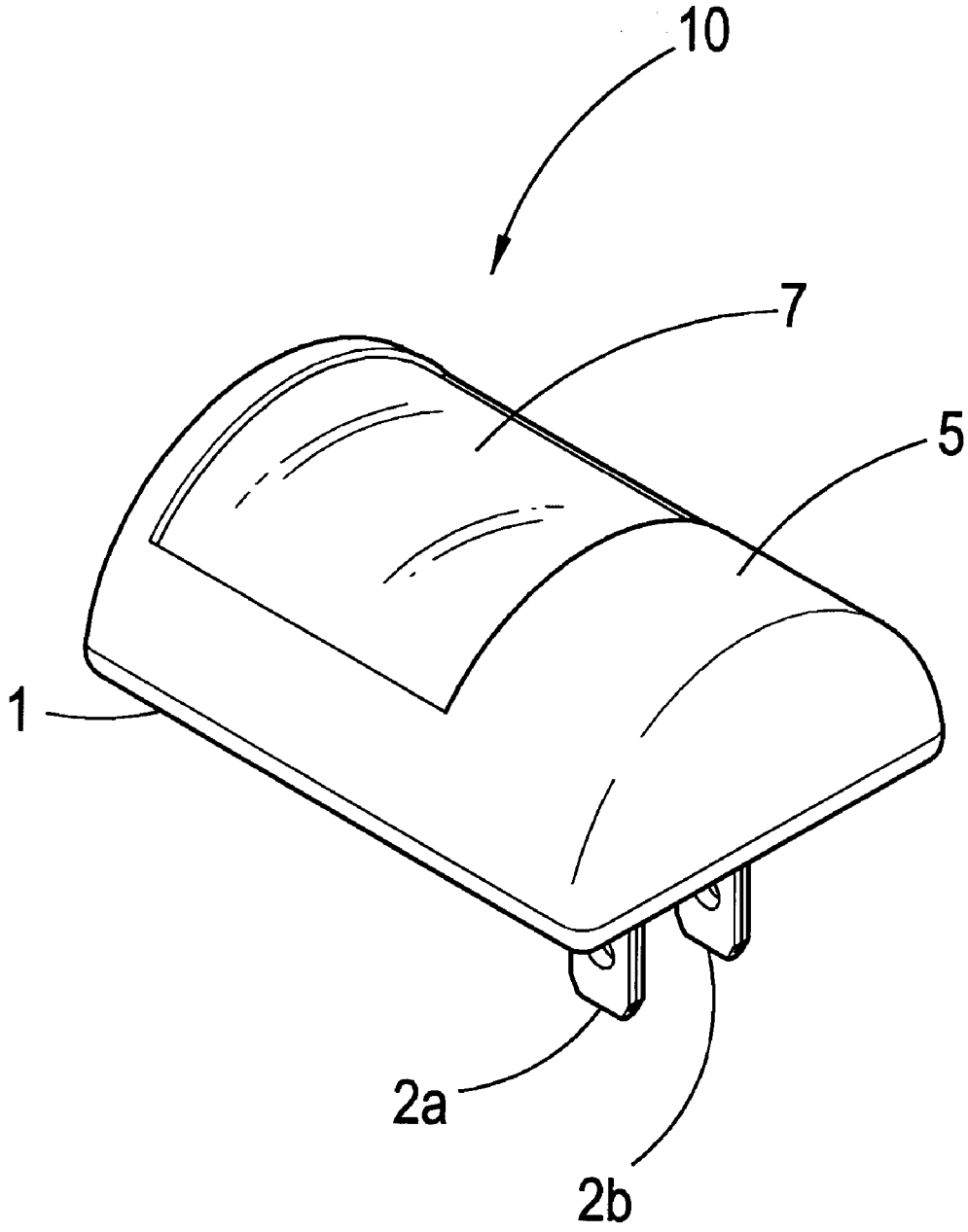
FIG. 1 shows a schematic three-dimensional view of the novel night lamp according to the invention.
Figure 2:
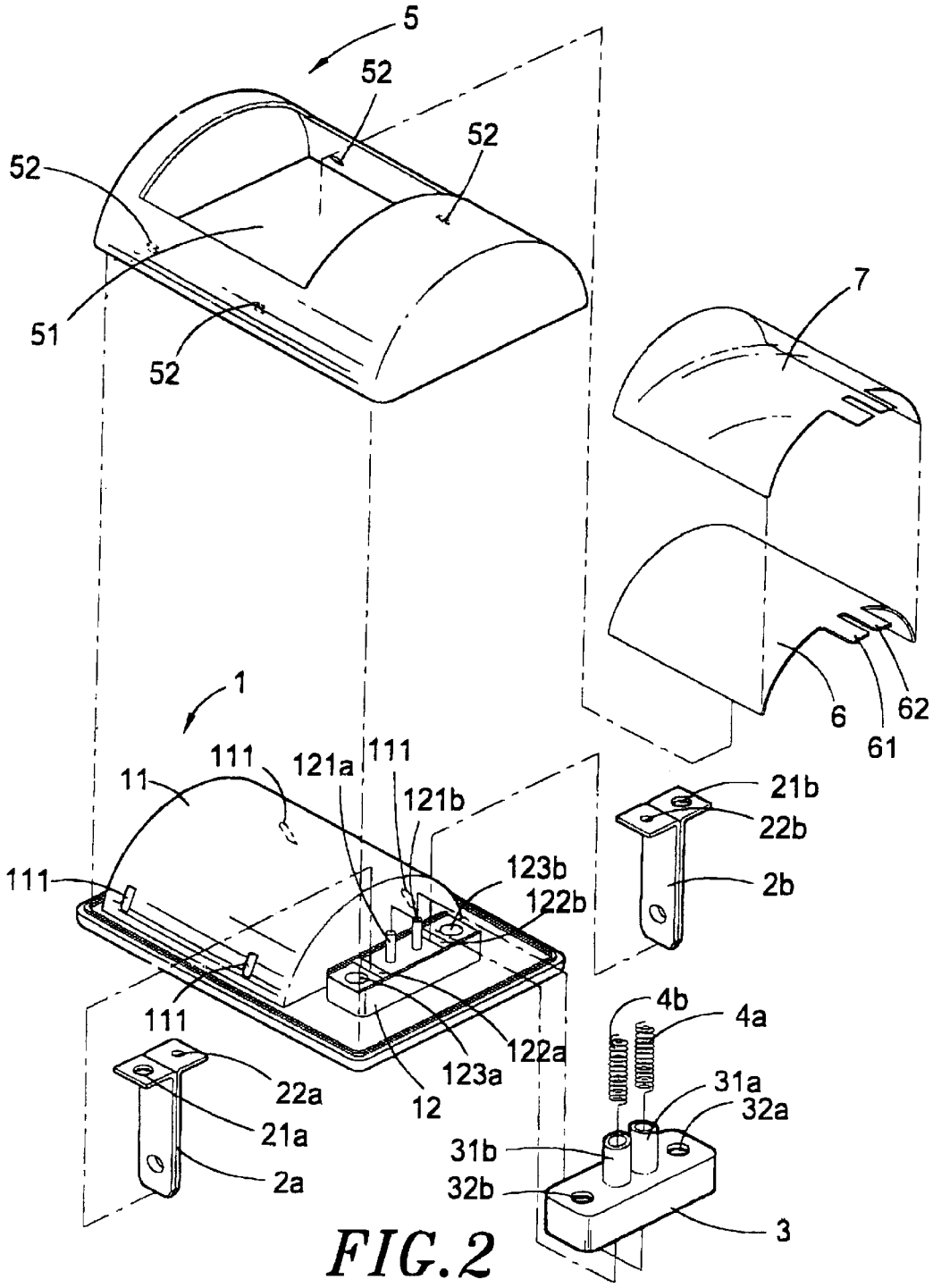
FIG. 2 shows a schematic dissected view of the above-described novel night lamp according to the invention.

Now, referring to FIGS. 1 and 2, the novel night lamp according to the invention comprises:

a night lamp body 1, having a semi-circular arc-like protruding block 11 extended thereon; wherein two snap engaging recesses 111 are provided along both lateral sides of said protruding block 11, and one positioning seat 12 is provided on one end of said protruding block 11; and wherein two shaft levers 121*a*, 121*b* are provided vertically on said positioning seat 12, and on both sides of said two shaft levers 121*a*, 121*b* are provided with slots 122*a*, 122*b* and positioning openings 123*a*, 123*b*, respectively;

two conductive copper pieces 2*a*, 2*b*, having a shape of T, and provided at the top-end thereof with two pairs of holes 21*a*, 22*a* and 21*b*, 22*b*, wherein one pair of holes 22*a*, 22*b* is to be slipped on said shaft levers 121*a*, 121*b* respectively, in a manner that lower ends of said holes 22*a*, 22*b* can penetrate through said slots 122*a*, 122*b* of positioning seat 12 at the back side of said night lamp body 1 to form a socket structure; and wherein the other pair of holes 21*a*, 21*b* are fitted on corresponding on positioning openings 123*a*, 123*b*, respectively;

a positioning set 3, provided with two engaging openings 32*a*, 32*b* at the top surface thereon; and provided with two hollow cylinders 31*a*, 31*b* extended vertically at about the central axis on its upper surface; wherein top ends of said hollow cylinders 31*a*, 31*b* are in a form of inclined openings; wherein said positioning set 3 is to slip on said positioning seat 12 in a manner that said shaft levers 121*a*, 121*b* having two copper pieces 2*a*, 2*b* slipped thereon can penetrate through said hollow cylinders 31*a*, 31*b*; that said engaging openings 32*a*, 32*b* at the top surface of said positioning set 3 can be fitted correspondingly with said positioning openings 123*a*, 123*b* on said positioning seat 12 as well as with said holes 21*a*, 21*b* on said conductive copper pieces 2*a*, 2*b*; and that, by fixing by means of a screw 8, said positioning set 3 and said conductive copper pieces 2*a*, 2*b* can be fitted securely on said positioning seat 12;

two conductive springs 4*a*, 4*b*, slipped on said shaft levers 121*a*, 121*b* on said positioning seat 12; wherein one end of said conductive springs 4*a*, 4*b* is to contact with the top end of said conductive copper pieces 2*a*, 2*b*, while the other end of spring 4*a*, 4*b* is to protrude out of said inclined openings at the top end of said hollow cylinder 31*a*, 31*b;* an upper shade 5, having a shape of semi-circular arc and provided with an open portion 51 thereon at a place corresponding with said protruding block 11; wherein two snap protrusions 52 are provided along the inner side at both lateral peripheries of said open portion 51;

a luminescent sheet 6, provided with extended conductive ends 61, 62 on an end thereof; wherein both lateral peripheries of said luminescent sheet 6 are fitted against said snap protrusions 52 on said upper shade 5 such that said luminescent sheet 6 can be affected by the circular arc curvature of said upper shade 5 and presents correspondingly in a shape of semi-circular arc as well as can protrude out of said open portion 51 on said upper shade 5; and a light diffusing sheet 7, overlying said luminescent sheet 6 such that light emitted by said luminescent sheet 6 can be refracted uniformly by said light diffusing sheet 7 and said luminescent sheet 6 can be protected from being destroyed;

wherein, said upper shade 5 is to cover said night lamp body 1 and bind integrally therewith by virtue of high frequency wave or ultrasonic bonding such that said night lamp 10 presents as a semi-cylinder to achieve the object of a novel and unique configuration; and wherein said snap protrusions 52 at both inner sides of said the inner peripheries on said open portion 51 on said upper shade 5 can engage with snap engaging recesses 111 on both sides of said protruding block 11 of said night lamp body such that said luminescent sheet 6 and said light diffusing sheet 7 can be held and fitted intimately against the surface of said protruding block 11.

Figure 3:
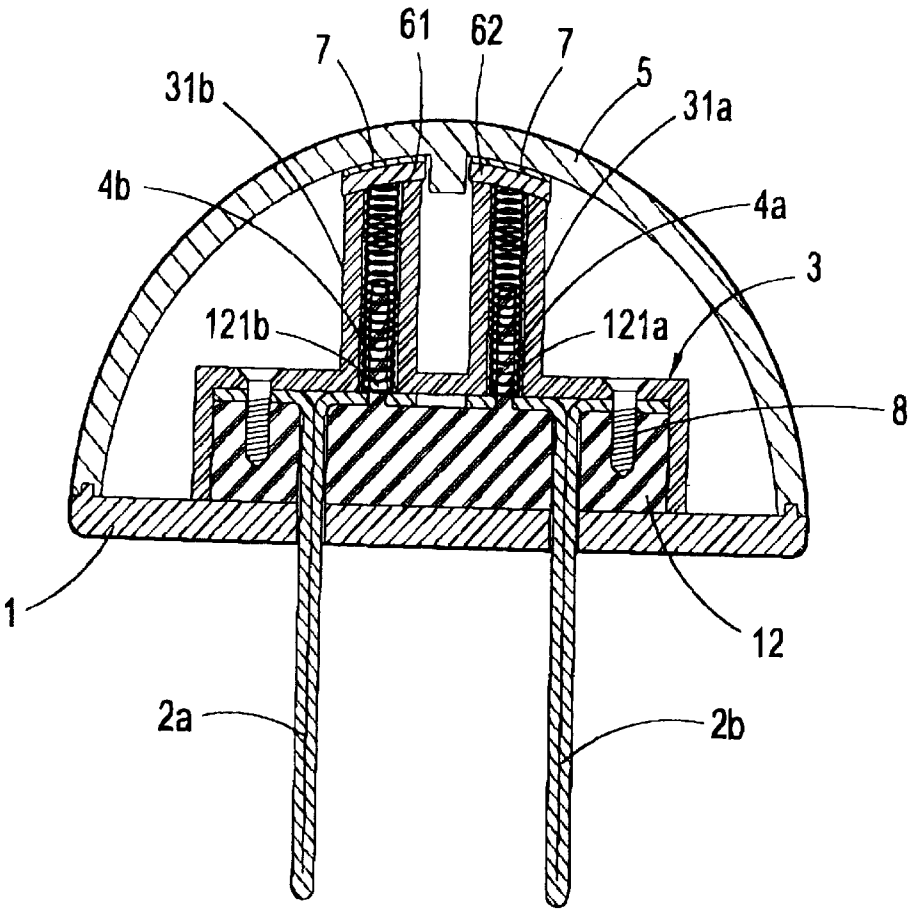
FIG. 3 shows a cross-section view of said novel night lamp according to the invention.

Now referring to FIG. 3, a cross section view of the novel night lamp according to the invention shows that, when said upper shade 5 covers said night lamp body 1, said conductive ends 61, 62 extended from both ends of said luminescent sheet 6 will contact said conductive springs 4*a*, 4*b* protruded out of the inclined openings of said hollow cylinders 31*a*, 31*b*. By virtue of the buffering characteristics of said conductive springs 4*a*, 4*b*, they can fit intimately against said conductive ends 61, 62 on said luminescent sheet 6 such that no poor contact will occur and that electric power can be conducted via said conductive copper pieces 2*a*, 2*b* and said buffering springs 4*a*, 4*b* to said conductive ends on said luminescent sheet 6 and thereby activates said luminescent sheet 6 to luminescence.

Figure 4:
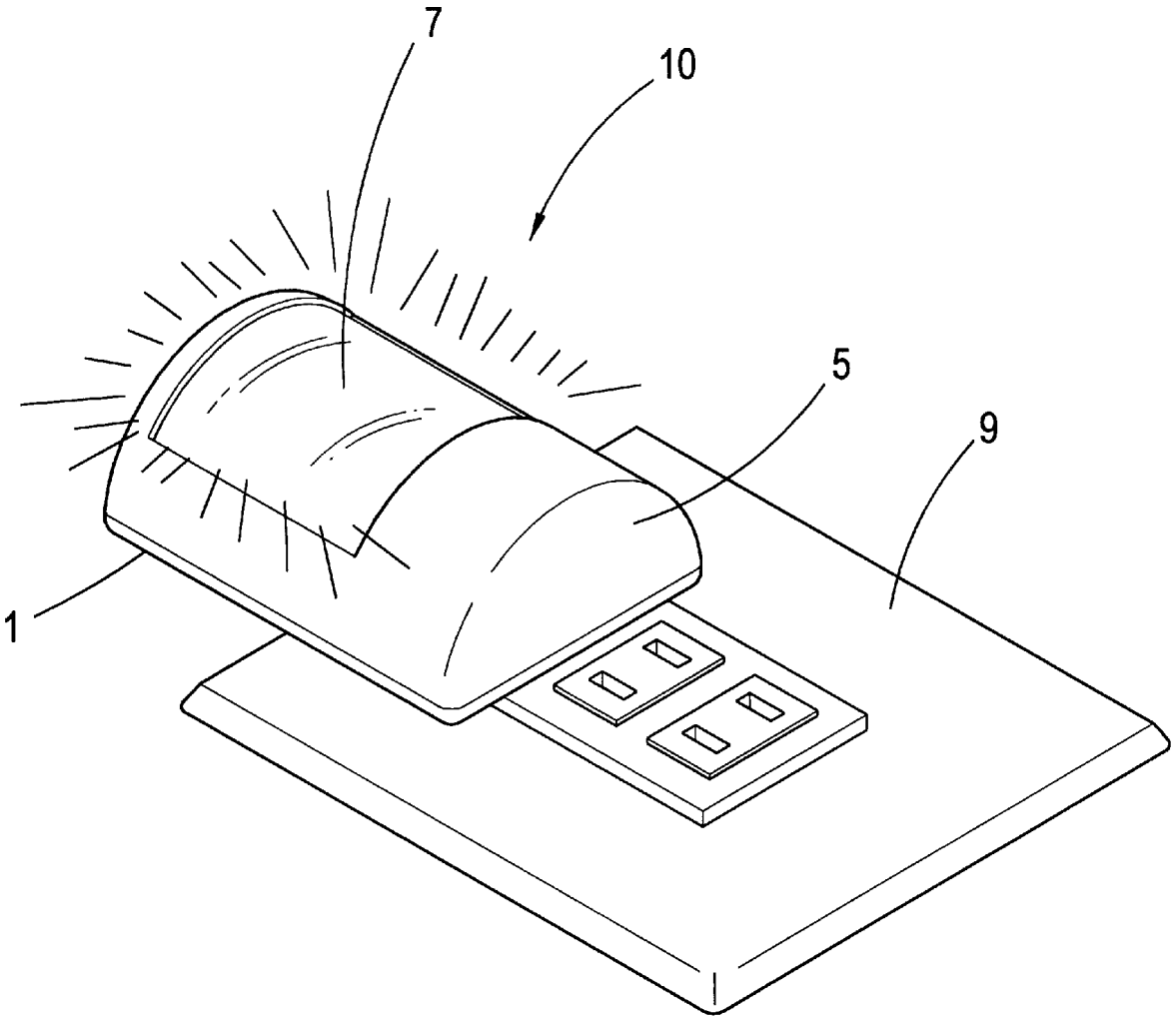
FIG. 4 is a schematic view showing the practical use of said novel night lamp according to the invention.

Referring to FIG. 4, a schematic view illustrates the practical use of the novel night lamp according to the invention. A socket structure formed by said two conductive copper pieces 2*a*, 2*b* can be plugged in a socket board 9. As a result, the electric power can be conducted via said conductive copper pieces 2*a*, 2*b* into said night lamp 10 so that said luminescent sheet 6 having a semi-circular arc plane will be activated to luminescence and lighten the dark place. Furthermore, by virtue of the semi-circular are-like configuration of said night lamp 10, an outstandingly visual effect can be achieved.

The night lamp according to the invention has following advantages compared with the prior art:

1. By virtue of the semi-circular are-like configuration of the night lamp according to the invention, the user can enjoy an outstandingly visual effect and hence the desire to buy and to use can be promoted.

2. The night lamp according to the invention uses a luminescent sheet as the main light source that imparts it many effects such as safety, power-saving, long service life and environment protecting.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A novel night lamp structure comprising a night lamp body having a protruding block, a plurality of snap engaging recesses formed on both lateral peripheries of said protruding block, a positioning seat formed on one end of said protruding block, two shaft levers formed vertically on said positioning seat, and a plurality of slots and positioning openings formed on both sides of said shaft levers, respectively; two conductive copper pieces, each of said copper pieces having a first hole and a second hole at a top end of the copper piece, and said first holes slipped on and fitted on said shaft levers in a manner such that the bottom ends of the copper pieces penetrate through said slots and protrude to opposite side of said protruding block; a positioning set having two hollow cylinders extended vertically at about a center of an upper surface of said positioning set, a top end of each of said hollow cylinders having an inclined opening, and wherein, said positioning set slipped on said positioning seat in a manner such that said shaft levers on said positioning seat penetrate through and held in said hollow cylinders; two conductive springs slipped on said shaft levers, and one end of each of said conductive springs contacts with the top end of said copper piece while the other end of each of said conductive springs protrudes out of the top end of said hollow cylinder; an upper shade having a shape of a semi-circular arc corresponding to a semi-circular arc of said protruding block and provided with an open portion, and a plurality of snap protrusions formed along the inner peripheries of the upper shade; a luminescent sheet having a plurality of conductive ends along one end of the sheet and fitted in said open portion as well as protruding out of said open portion of said upper shade by means of said snap protrusions; a light diffusing sheet overlying said luminescent sheet, said upper shade covering said night lamp body such that said snap protrusions along the inner peripheries of said upper shade engaged with said snap engaging recesses along the peripheries of said protruding block, and wherein said luminescent sheet is held between said upper shade and said protruding block and fitted intimately against a surface of said protruding block, and the conductive ends of said luminescent sheet contact with said conductive springs such that electric power is conducted through said copper pierces and said conductive springs to said conductive ends of said luminescent sheet to activate said luminescent sheet to luminesce.

2. A novel night lamp structure as claimed in claim 1, wherein said luminescent sheet is affected by the arc curvature of said upper shade and formed into a semi-circular arc shape; and as said upper shade covers said night lamp body, an entire configuration of said night lamp structure presents a semi-cylindrical form.

3. A novel night lamp structure as claimed in claim 1, wherein said copper pieces are T-shape.

4. A novel night lamp structure as claimed in claim 1, wherein the second holes on said copper pieces are fitted correspondingly with said positioning openings on said positioning seat, and subsequently, when said positioning set covers said positioning seat, a pair of engaging openings on said positioning set fitted correspondingly with said positioning openings, and a screw penetrating through each of said second holes, each of said positioning openings and each of said engaging openings to secure said positioning set and said copper pieces on said positioning seat.

5. A novel night lamp structure as claimed in claim 1, wherein said plurality of snap protrusions are comprised of four snap protrusions, and said plurality of snap engaging recesses are comprised of four snap engaging recesses.

6. A novel night lamp structure as claimed in claim 1, wherein said upper shade and said night lamp body are securely connected into an integral body by means of ultrasonic bonding.

* * * * *